US006126057A

United States Patent [19]

Li

[11] Patent Number: 6,126,057

[45] Date of Patent: Oct. 3, 2000

[54] MAGAZINE STRUCTURE FOR NAILING MACHINES

[76] Inventor: Ming Chu Li, 1660 E. Park Ave., Chandler, Ariz. 85225

[21] Appl. No.: 09/258,719

[22] Filed: Feb. 26, 1999

[51] Int. Cl.[7] ..... B25C 7/00

[52] U.S. Cl. ..... 227/136; 227/137

[58] Field of Search ..... 227/120, 135, 227/136, 137

[56] References Cited

U.S. PATENT DOCUMENTS

| | | | |
|---|---|---|---|
| 2,219,484 | 10/1940 | Lyon | 227/137 |
| 3,664,565 | 5/1972 | Heilman | 227/137 |
| 4,091,981 | 5/1978 | Moriguchi et al. | 227/137 |
| 4,433,782 | 2/1984 | Figge et al. | 227/136 |
| 4,585,154 | 4/1986 | Fealey et al. | 227/136 |
| 5,683,024 | 11/1997 | Eminger et al. | 227/136 |
| 5,931,366 | 8/1999 | Muro | 227/136 |

*Primary Examiner*—Scott A. Smith
*Attorney, Agent, or Firm*—Ming Chu Li; Yue Kin Chu

[57] ABSTRACT

An improved magazine structure for nailing machines includes a magazine body. The magazine body includes a base disk, a supporting disk, and a rod fixedly disposed on the supporting disk. The base disk is provided with a slot for passage of the rod. The rod has a sliding wheel disposed at a bottom portion thereof to allow the rod to displace slidably along the slot. The rod is disposed at a central position of the base disk, whereby the rod disposed at the central position of the base disk is caused to displace slidably outward to bring the support disk to displace therewith, so that a nail reel can be fitted vertically onto the supporting disk to achieve convenient and quick installation of the nail reel.

1 Claim, 3 Drawing Sheets

MAGAZINE STRUCTURE FOR NAILING MACHINES

BACKGROUND OF THE INVENTION (a) Field of the Invention

The present invention relates to an improved magazine structure for nailing machines, more particularly to a magazine structure which is convenient and quick to install.

(b) Description of the Prior Art

FIG. 1 shows a conventional nailing machine. It essentially comprises a nailing mechanism A and a magazine B. The nailing mechanism is provided to strike nails on a nail reel C. The magazine B is located below a handle A1 of the nailing mechanism and is substantially cylindrical. The magazine B includes a base disk and a rod B1 projecting upwardly from a central portion of the base disk. The rod B1 is provided mainly for fitting of the nail reel C. One side of the magazine B is provided pivotally with a magazine cover B2. The magazine cover B2 is used to prevent the nail reel C from falling out after it has been installed inside the magazine B. The nail reel C is comprised of a multiplicity of nails C that are interconnected by using strings and is centrally provided with a round through hole for passage of the rod B1. In use, the nail reel C is inserted into the magazine B with the round through hole fitted over the rod B1 to be supported thereby and retained in the magazine B. The ends of the nail reel C is pulled and mounted in a striking track of the nailing mechanism A, and the magazine cover B2 is put in position to accomplish installation of the nail reel C for nailing purposes. However, as the magazine B is located below the handle Al and on one side of the nailing mechanism A during mounting of the nail reel C, and the rod B1 projecting from the base disk is fixed, the nail reel C cannot be directly and vertically fitted onto the rod B1 due to its own length and the height of the handle A1 and the rod B1, and the nail reel C has to be held slantingly and moved sideways to cause the round through hole of the nail reel C to align with the rod B1 in order to fit the nail reel C onto the rod B1, which is very convenient.

SUMMARY OF THE INVENTION

A primary object of the present invention is to provide an improved magazine structure for nailing guns, which allows convenient and quick installation of nail reels.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
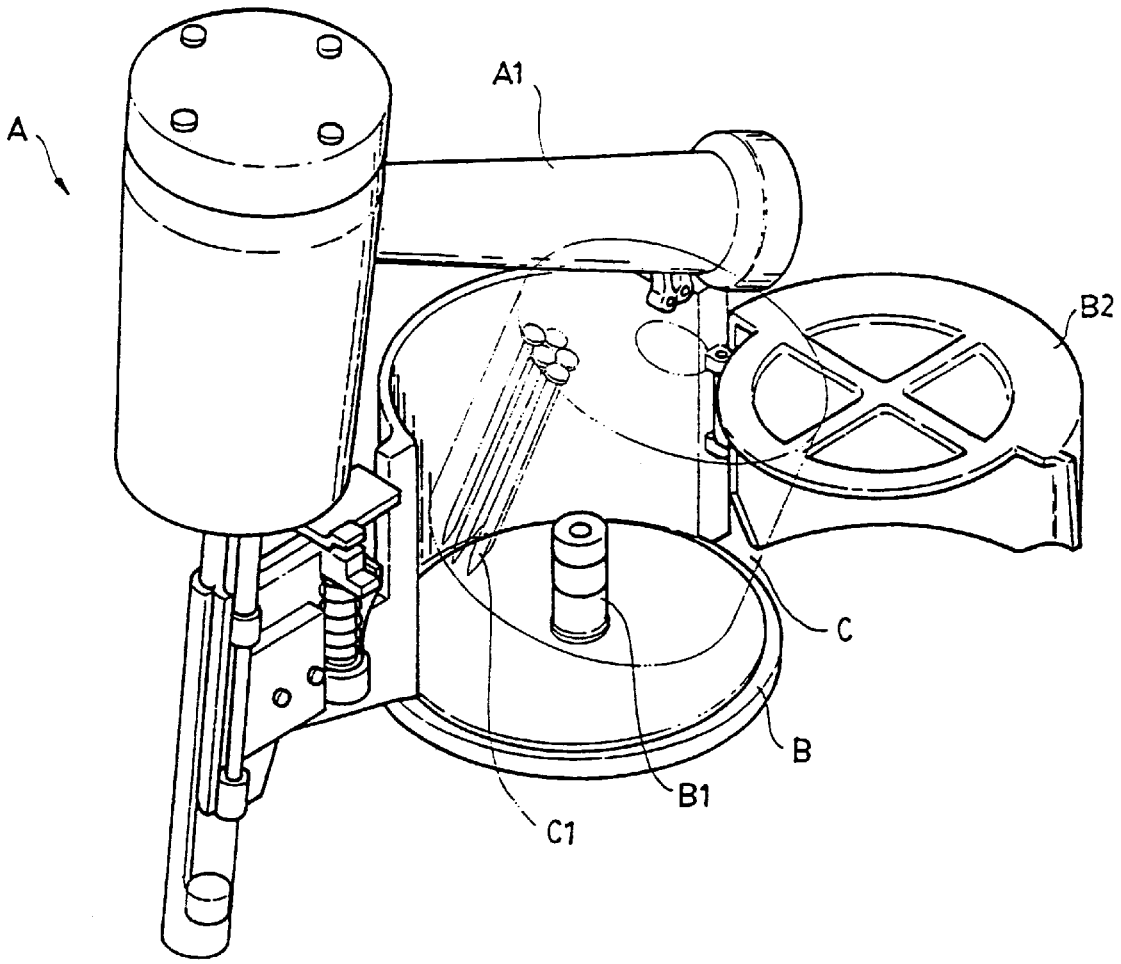
FIG. 1 PRIOR ART
FIG. 1 is a perspective schematic view of a conventional nailing machine, showing installation of a nail reel.
Figure 2:
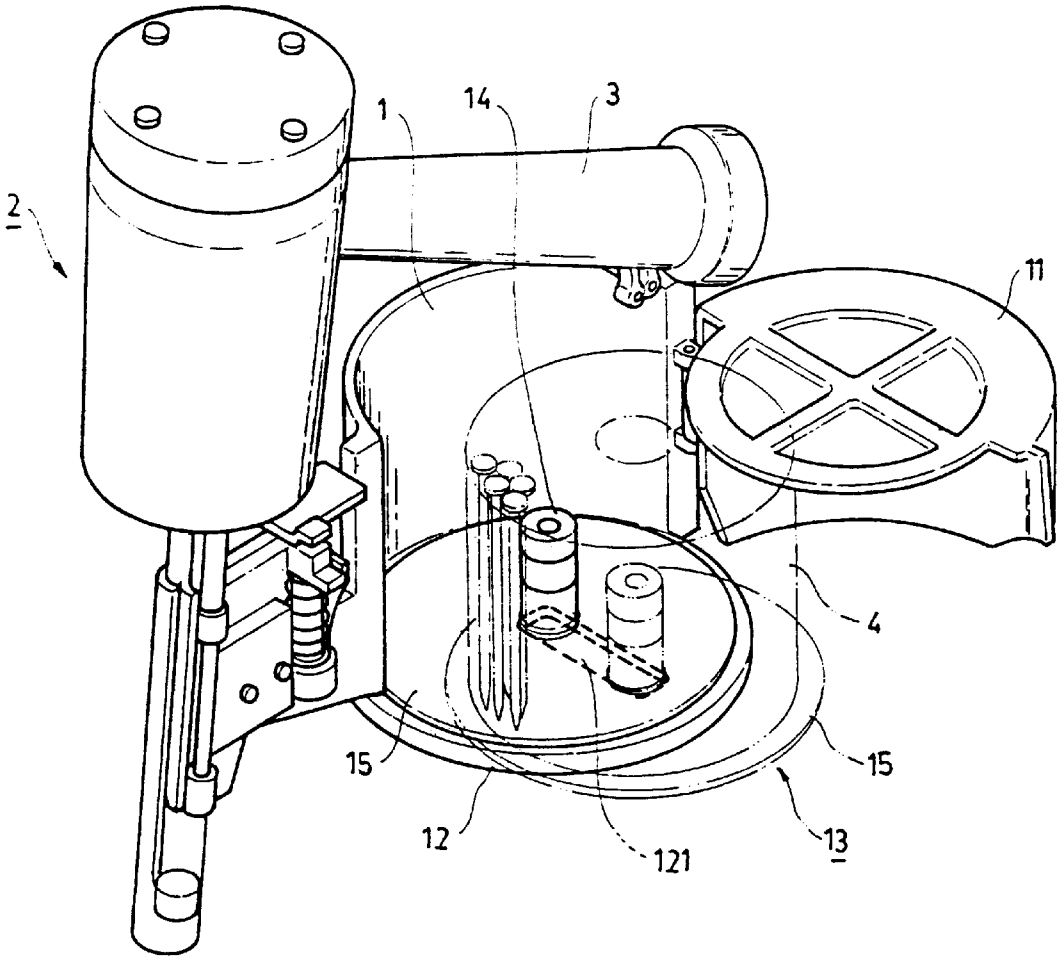
FIG. 2 is a perspective schematic view of the present invention, illustrating installation of a nail reel.
Figure 3:
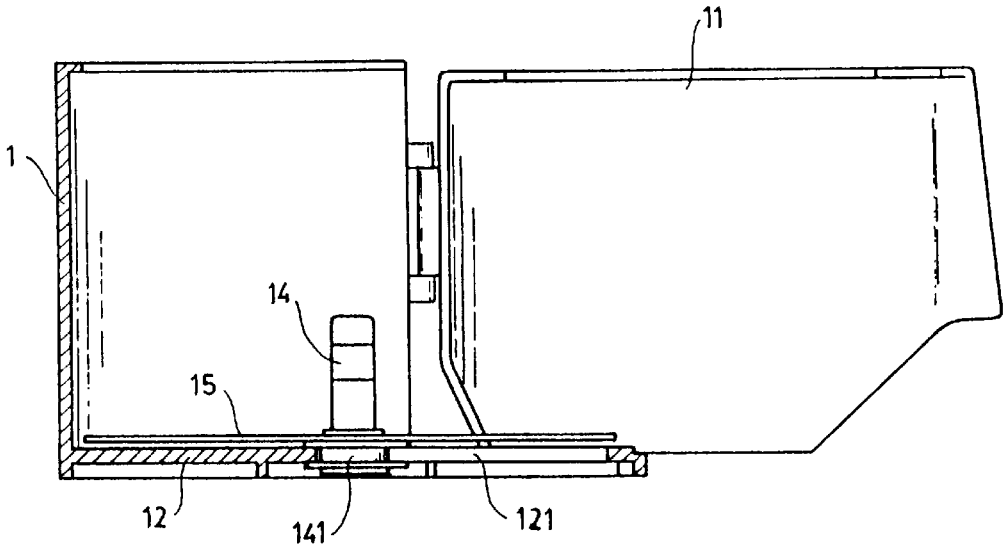
FIG. 3 is a sectional view of the present invention prior to slidable displacement of a rod supporting disk of the present invention.
Figure 4:
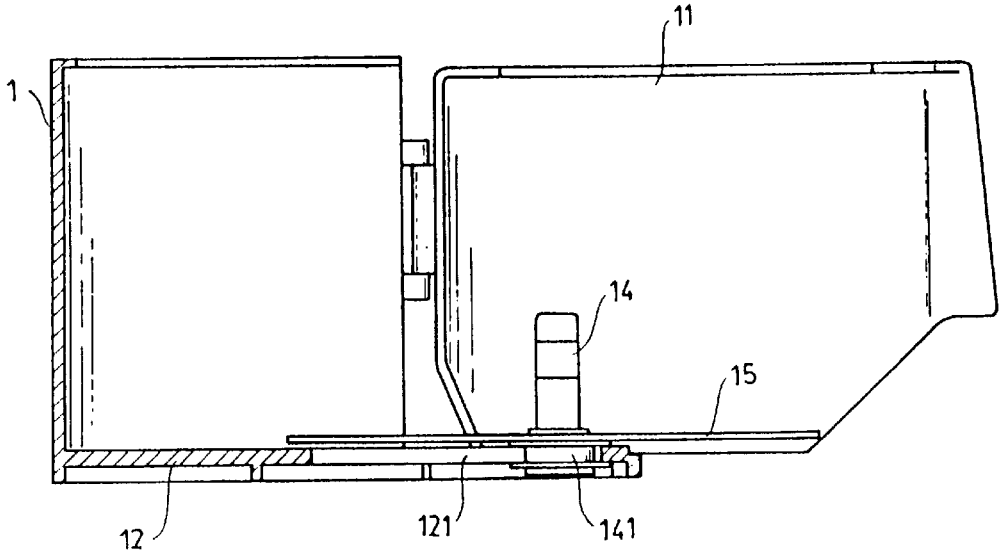
FIG. 4 is a sectional view of the present invention, showing slidable displacement of the rod supporting disk along a slot of a base disk.

With reference to FIGS. 2, 3, and 4, a preferred embodiment of a magazine assembly for nailing machines according to the present invention comprises a magazine body 1 that is directly and fixedly connected between one side of a striking mechanism 2 at a suitable position and below a bottom end of a handle 3. As the construction and the shape of the striking mechanism 2 and the handle 3 are known in the art, they are not discussed in detail herein. The magazine body 1 is pivotally connected to a magazine cover 11. The magazine cover 11 is configured such that a nail reel 4 inside the magazine body 1 are prevented from falling out. The magazine body 1 further has a circular base disk 12 extending therefrom. A slot 121 is formed in the circular base disk 12 at a suitable position. There is further provided a rod supporting disk 13 that includes a supporting disk 15 and a rod 14 projecting from a central portion of the supporting disk 15. The rod 14 includes a cylindrical upper end that projects from an upper side of the supporting disk 15 for insertion of the nail reel 4, and a bottom portion that has a sliding wheel member 141 that passes through the bottom side of the supporting disk 15 to be projecting therefrom. The sliding wheel member 141 on the bottom portion of the rod 14 is just located in the slot 121 of the base disk 12. The sliding wheel member 141 has an internal diameter slightly smaller than the width of the slot 121, but its external diameter is slightly larger than that the slot 121. Therefore, the sliding wheel member 141 may just be retained in the slot 121 and can freely slide along the slot 121. The rod 14 and the supporting disk 15 are fixedly connected. The supporting disk 15 is placed on the base disk 12 of the magazine body 1. When the rod 14 slidably displaces along the slot 121, the supporting disk 15 will move along therewith. The supporting disk 15 is provided mainly for receiving the nail reel 4. The present invention is primarily characterized in that the base disk 12 of the magazine body 1 is formed with the slot 121. The slot 121 is provided to permit passage of the rod 14 of the rod supporting disk 13 therethrough. In addition, the rod can freely and slidably displace along the slot 121 by means of the sliding wheel member 141 on the bottom portion thereof. During slidable displacement, the rood 14 can bring the supporting disk 15 to displace therewith simultaneously, whereby the rod 14 that is originally located at the central position of the base disk 12 can slidably and freely displace to facilitate fitting of the nail reel 4.

In use, when it is desired to install the nail reel 4 in the present invention, the magazine cover 11 is firstly opened, and the rod 14 of the rod supporting disk 13 is pulled along the slot 121 of the base disk 12, the rod 14 utilizing the sliding wheel 141 on its bottom to slidably displace. At the same, time, the supporting disk 15 will displace with the rod 14. Hence, the rod 14 originally at the central portion of the base disk 12 can be caused to slide outwardly and change position. The user can then fit the nail reel 4 directly and vertically onto the rod 14 to be supported on the supporting disk 15. And when the nail reel 4 is completely placed on the supporting disk 15, the nail reel 4 together with the supporting disk 15 can be pushed reversely to return to its original position, so that the supporting disk 15 returns to the position right above the base disk 12, and the rod 14 returns to its position at the center of the base disk 12. Finally, the magazine cover 11 is put in place to prevent the nail reel 4 from falling out.

In summary, the present invention utilizes a base disk provided with a slot to allow a rod supporting disk to displace slidably outward, so that fitting of the nail reel on the rod will not be obstructed by the handle and the nail reel can be directly and vertically installed in position, thus achieving convenient and quick installation of the nail reel in the nailing machine, and eliminating the drawbacks of the prior art.

Although the present invention has been illustrated and described with reference to the preferred embodiment thereof, it should be understood that it is in no way limited to the details of such embodiment but is capable of numerous modifications within the scope of the appended claims.

What is claimed is:

1. An improved magazine structure for nailing machines, comprising a magazine body that includes a base disk, a supporting disk, and a rod fixedly secured to said supporting disk, said base disk being provided with a slot for passage of said rod, said rod having a sliding wheel disposed at a bottom portion thereof to allow said rod to displace slidably along said slot, and being disposed at a central position of said base disk, whereby said rod disposed at the central position of said base disk is caused to displace slidably outward to bring said support disk to displace therewith, so that a nail reel can be fitted vertically onto said supporting disk to achieve convenient and quick installation of the nail reel.

* * * * *